US010418756B2

(12) United States Patent
Fennen et al.

(10) Patent No.: US 10,418,756 B2
(45) Date of Patent: Sep. 17, 2019

(54) PLUG CONNECTOR WITH INTEGRATED GALVANIC SEPARATION AND SHIELDING ELEMENT

(71) Applicant: HARTING (Zhuhai) Manufacturing Co., Ltd., Zhuhai, Guangdong (CN)

(72) Inventors: Lars Fennen, Westoverledingen (DE); Junmin Guo, Guangdong (CN); Yingtao Wang, Guangdong (CN)

(73) Assignee: HARTING (Zhuhai) Manufacturing Co., Ltd., Zhuhai, Guangdong (CN)

( * ) Notice: Subject to any disclaimer, the term of this patent is extended or adjusted under 35 U.S.C. 154(b) by 0 days.

(21) Appl. No.: 16/075,469

(22) PCT Filed: Aug. 26, 2016

(86) PCT No.: PCT/CN2016/096947

§ 371 (c)(1),
(2) Date: Aug. 3, 2018

(87) PCT Pub. No.: WO2017/133224

PCT Pub. Date: Aug. 10, 2017

(65) Prior Publication Data

US 2019/0044290 A1 Feb. 7, 2019

(30) Foreign Application Priority Data

Feb. 4, 2016 (WO) ..... PCT/CN2016/073561

(51) Int. Cl.
*H01R 24/00* (2011.01)
*H01R 13/66* (2006.01)
(Continued)

(52) U.S. Cl.
CPC ..... *H01R 13/6633* (2013.01); *H01R 12/716* (2013.01); *H01R 13/506* (2013.01);
(Continued)

(58) Field of Classification Search
CPC .... H01R 24/86; H01R 12/716; H01R 13/506; H01R 13/6633; H01R 13/6658; H01R 2107/00
(Continued)

(56) References Cited

U.S. PATENT DOCUMENTS 4,871,320 A * 10/1989 Mouissie ..... H01R 13/506 439/78
5,382,182 A * 1/1995 Shen ..... H01R 24/62 439/425
(Continued)

FOREIGN PATENT DOCUMENTS

CN 101542849 A 9/2009
CN 102801059 A 11/2012
(Continued)

OTHER PUBLICATIONS

International Search Report and Written Opinion, dated Dec. 5, 2016, for International Application No. PCT/CN2016/096947, 8 pages.
(Continued)

*Primary Examiner* — Abdullah A Riyami
*Assistant Examiner* — Vladimir Imas
(74) *Attorney, Agent, or Firm* — Seed IP Law Group LLP

(57) ABSTRACT

To avoid the disadvantages of additionally required space, unwanted crosstalk and deterioration in transmission properties that are concomitant with a separate transformer, a plug connector is proposed, comprising: a plug base with terminal contacts for external contacting of the plug connector, base-side connection contacts, and a transformer unit for galvanic separation in a conductive path between the terminal contacts and the base-side connection contacts and a plug body with plug contacts, the plug base and the plug body enclosing a contact element for connecting the base-
(Continued)

side connection contacts to the plug contacts and the contact element being planar in a plane perpendicular to a plug-in direction of the plug body. A shielding element for the plug connector is also proposed.

15 Claims, 8 Drawing Sheets

(51) Int. Cl.
*H01R 12/71* (2011.01)
*H01R 13/506* (2006.01)
*H01R 24/86* (2011.01)
*H01R 107/00* (2006.01)

(52) U.S. Cl.
CPC ..... *H01R 13/6658* (2013.01); *H01R 24/86* (2013.01); *H01R 2107/00* (2013.01)

(58) Field of Classification Search
USPC ..... 439/676
See application file for complete search history.

(56) References Cited

U.S. PATENT DOCUMENTS 5,387,135 A * 2/1995 Shen ..... H01R 24/62 439/676
5,713,762 A * 2/1998 Mitra ..... H01R 12/716 439/108
6,244,908 B1 * 6/2001 Hammond ..... H01R 13/7031 200/51.03
6,394,853 B1 * 5/2002 Hammond ..... H01R 13/70 439/676
6,404,111 B1 * 6/2002 Kunkel ..... C02F 1/325 250/436
6,835,092 B2 * 12/2004 Wan ..... H01R 13/6658 439/541.5
7,785,135 B2 * 8/2010 Wu ..... H01R 13/719 439/490
7,854,634 B2 * 12/2010 Filipon ..... H01R 13/6658 439/676
8,333,599 B2 * 12/2012 Xu ..... H01R 13/6658 439/676
8,415,895 B2 * 4/2013 Hofmann ..... H01R 13/6658 315/250
8,591,261 B2 * 11/2013 Das ..... H01R 13/6477 439/620.05
8,708,714 B2 * 4/2014 Niitsu ..... H01R 12/716 439/660
8,814,598 B2 * 8/2014 Hein ..... H01R 13/5812 439/455
8,888,538 B2 * 11/2014 Regnier ..... H01R 12/724 439/676
8,979,591 B2 * 3/2015 Mehnert ..... H01R 13/622 439/607.41
9,093,796 B2 * 7/2015 Taylor ..... H01R 13/703
9,203,198 B2 * 12/2015 Pepe ..... H01R 13/6658
9,525,255 B2 * 12/2016 Pepe ..... H01R 13/6658
9,843,121 B1 * 12/2017 Sparrowhawk ..... H01R 13/187
10,014,607 B1 * 7/2018 Govari ..... H01R 24/58
10,224,676 B2 * 3/2019 Hemmerlein ..... G01R 33/36
2010/0048061 A1 2/2010 Helmig et al.
2010/0233905 A1 9/2010 Nagata
2013/0137310 A1 5/2013 Genau
2015/0325956 A1 11/2015 Schreier et al.

FOREIGN PATENT DOCUMENTS

CN 103329359 A 9/2013
CN 103579820 A 2/2014
CN 204179420 U 2/2015
DE 201 21 594 U1 2/2003
DE 10 2012 105 256 A1 12/2003
EP 1 936 752 A2 6/2008
TW 201532352 A 8/2015
WO 2012/041310 A1 4/2012

OTHER PUBLICATIONS

International Search Report and Written Opinion, dated Nov. 10, 2016, for International Application No. PCT/CN2016/073561, 8 pages.

* cited by examiner

6/8

PLUG CONNECTOR WITH INTEGRATED GALVANIC SEPARATION AND SHIELDING ELEMENT

BACKGROUND

Technical Field

The present disclosure relates to a plug connector with integrated galvanic separation. The disclosure also relates to a shielding element which may be used in such plug connector and/or in other plug connectors.

Description of the Related Art

In the field of industrial plug connectors, and specifically in the field of round plug connectors such as the M12 series, Ethernet protocols are being used to an increasing extent, for example in the field of industrial Ethernet switches.

In order to protect the transceiver and to ensure a desired signal quality, the IEEE 802.3 standard, for example, specifies galvanic separation of the PHY side (the Physical Layer; i.e., the transceiver side) from the MDI side (Medium Device Interface; i.e., the plug connector and CAT cable), said separation generally being realized by a transformer.

Such transformers have conventionally been provided between the actual chip and the respective plug connector, i.e., they were interposed as separate components.

In the field of RJ plugs (RJ45 plugs, in particular) "MagJacks", for example, in which the transformer is integrated in the plug socket, are known. The contacts inside the RJ socket are arranged on the inner surface surrounding an inserted plug. The transformers, and more particularly a printed circuit board on which the transformers are mounted, are arranged along a portion of such an inner surface, typically parallel to and offset from a plane defined by the contact surfaces.

Such an approach is not transferable to other plug connection concepts in which the contacts are on the inside, i.e., are enclosed by the counterpart of the plug connector when contact is made.

Furthermore, RJ45 plugs are not considered reliable enough for numerous industrial plug applications, due to their particular construction.

In the field of M12 plug connectors, for example, the transformers are still provided as separate components at present. Providing such separate components increases the amount of construction space that is required. Additionally, the layout of a circuit board, on which the plug connector is to be mounted, becomes more complex in view of the need for sufficient air gaps and leakage clearances. Another factor is that the conductors which are then needed can produce additional crosstalk on the transceiver chip, which is generally sensitive. Besides the additional work involved in placing the components on the circuit board, the additional wiring involved also has negative impacts on the transmission characteristics (signal integrity).

There is therefore a desire for a plug connector concept which can ensure the galvanic separation between the PHY and the MDI side as required by IEEE 802.3, for example, and with which the aforementioned disadvantages, i.e., additionally required construction space, a need for sufficient air gaps and leakage clearances, additional crosstalk on the transceiver chip, extra work involved for installation and deterioration in transmission characteristics, can be avoided, or at least reduced in comparison with conventional separate design.

In the context of industrial plug connectors, there is furthermore a desire for an electrical contacting in a shielding manner between the plug connector (or parts thereof) and a housing. Example of means for such shielding connection are described in DE 10 2012 105 256 A1 and WO 2012/041310 A1.

DE 10 2012 105 256 A1 discloses an insulation body for a plug connector which is provided with a shielding spring having a shape similar to that of a clover leaf, which is provided inside a partially circumferential slot in the insulation body, electrically contacting a shielding cross inside the insulation body. The shielding spring extends laterally to the outside of the insulation body and thus allows for a conductive contact with a housing for the plug connector.

WO 2012/041310 A1 discloses plug connector having an insulation body provided with a circumferential groove, in which a shielding spring is provided in the form of a helical spring, so to allow for a conductive connection between a shielding cross of the plug connector and a (grounded) front plate insert.

A difficulty involved with such shielding springs is that-under given circumstances-there might be a need for a relative strong force to be exerted upon assembling the plug connector with the housing, involving the risk of damaging a circuit board to which the plug connector is attached.

In the case of DE 10 2012 105 256 A1, it may happen that the shielding spring is offset inside the slot such that it blocks the passage of the plug connector into the housing or housing sleeve. With regard to WO 2012/041310 A1, there is furthermore a possibility that the helical shielding spring is moved out of its groove during the insertion of the plug connector into the front plate insert, while the moving may severe the electrical connection between the shielding spring and the shielding cross.

Also known are arrangements where there is provided on a ledge a connection element in the form of a curved disc spring or a wave washer, which is then compressed upon insertion of the plug into the sleeve so to provide for a conductive connection. A similar arrangement provides for only a partially surrounding connection element (e.g., having a form similar to a C), wherein the arms of the connection element extend obliquely so to being bend upon connection.

A disadvantage of such arrangements is that the reliability of the connection depends on the accuracy of the positioning of the plug connector in the circuit board in the direction of compression of the connection element, as possibly to compression of the connection element might be insufficient for a good connection.

There is thus also a desire for a shielding element for a plug connector allowing for a reliable electrical connection basically irrespective of the positional accuracy of the placement of the plug connector, while reducing a risk of damage in view of the forces needed for providing the electrical connection.

BRIEF SUMMARY

Embodiments of the present invention provide a plug connector comprising a plug base with terminal contacts for external contacting of the plug connector, base-side connection contacts, and a transformer unit for galvanic separation in at least a conductive path between the terminal contacts and the base-side connection contacts, and a plug body with plug contacts, the plug base and the plug body enclosing a contact element for connecting the base-side connection contacts to the plug contacts and the contact element being planar in a plane perpendicular to a plug-in direction of the plug body.

It has been found that the transformer unit can be disposed behind the actual plug body in the plug-in direction but between the plug body and the terminal contacts of the plug connector in electrical terms, with the plug body being brought into contact with the transformer unit by a contact element which is disposed in a plane between the plug body and a plug base.

A plug connector according to one or more embodiments of the invention is substantially identical to a corresponding type of conventional plug connector with regard to its constructional requirements, in terms of the amount of surface it requires on a circuit board. The installation work associated with this separate placement of the transformer(s) is separated from the actual installation work to produce the plug connector as such, thus allowing specialization in this regard and an increase in efficiency. The comparatively more compact design reduces the potential amount of crosstalk, which can also be shielded by the plug connector casing. The more compact design also has positive impacts on the transmission characteristics.

In one advantageous embodiment, the contact element is embodied as a printed circuit board. With a printed circuit board, the electrical connections can be easily produced by known methods, for example by printing or etching conductive strips.

In another advantageous embodiment, the contact element has outer through holes and inner through holes through which the connecting contacts on the base side and the plug contacts respectively extend, in which the base-side connecting contacts and the plug contacts are fixed, and with which the base-side connecting contacts and the plug contacts are electrically connected, and which are connected to each other by conductors. It is advantageous if the contact element can be firstly connected to the plug body, for example, the plug contacts extending (with a section in the form of a pin, for example) through the respective inner through holes and being electrically fixed thereto, for example by soldering. During further assembly, the base-side connection contacts and the terminal contacts (in the form of pins, for example) are introduced into the respective outer through holes and likewise fixed there electrically, for example by soldering. Since there is an electrical connection between each of the one or more outer through holes and the one or more inner through holes, there is continuous contact between the terminal contacts and the plug contacts via the transformer unit (with at least partial galvanic separation), the base-side connection contacts and the contact elements.

The contact element does not necessarily have to be provided with (inner and/or outer) through holes. It is likewise possible, for example, to provide contact surfaces with which the respective contacts are established, or onto which the base-side connection contacts and/or the plug contacts are pressed. Electrical fixation can be likewise achieved, in the case of (inner and/or outer) through hole, by an elastic or plastic fit or forming. The contact to each respective contact element is advantageously achieved by way of a technique for soldering in, e.g., by the so-called "paste-in-hole" technique, in which conductive (and initially still deformable) material (solder paste) is provided in the through holes by which the inserted contacts are soldered to the contact element, thus being electrically connected and mechanically fixed.

In one advantageous embodiment, the contact element is adapted for a one-to-one arrangement of the contact element in relation to the base-side connecting contacts and/or the plug contacts. In one variant of this embodiment, the inner and/or outer through holes are each provided in such a way that a one-to-one arrangement of the contact element in relation to the base-side connecting contacts and/or the plug contacts is provided. For example, by positioning and/or dimensioning the through holes accordingly, it is possible to ensure that, when assembling the plug connector, this relative positioning is possible in one predefined form only (since blocking of contact is otherwise the result). This prevents the terminal contacts and plug contacts from being wrongly assigned to each other as a result of an incorrect arrangement of base-side connection contacts, plug contacts and contact elements. However, safeguards against incorrect installation can also be achieved independently of the through holes (or in addition thereto) by providing suitable recesses and/or projections which cooperate with respective counterparts in the plug base or plug body.

In another advantageous embodiment, ends of the terminal contacts are arranged in a plane which is parallel to the plane of the contact element, or perpendicular thereto. With such an arrangement, the plug-in direction is either perpendicular or parallel to a plane of a circuit board or similar on which the plug connector is mounted. However, it is also basically possible to provide a slanted plug-in direction.

In yet another advantageous embodiment, the plug connector is a round plug connector. In one variant of this embodiment, the round plug connector is an M12, M8 or M6 plug connector. Round plug connectors, and specifically the M12, M8 and M6 types, are, due to their robustness, in particular as to the reliability of their plug connection, widespread connector types in the industrial field, thus allowing the plug connector according to embodiments of the invention to be easily integrated into existing systems.

Other embodiments of the present invention provide a shielding element for a plug connector and contacting a casing sleeve of the plug connector, the shielding element being ribbon shaped and arranged for extending at least partially around a wall of the plug connector which extends in a connection direction of the plug connector and the casing sleeve, wherein the shielding element includes one or more tabs extending obliquely, so to form an acute angle which faces away from the casing sleeve upon connection of the plug connector and the casing sleeve.

The basic arrangement of the shielding element when it extends around the wall of the plug connector is similar to a tube, through which the wall of the plug connector extends, even though it is not necessarily the case that the shielding element indeed extends completely around the wall of the plug connector (in other words, a section of the tube may be missing). This "tube" (or partial "tube") does not have to have a constant basis cross section, as other forms are also possible, depending on the particular geometry of plug connector and casing sleeve. The shielding element corresponds in its cross sectional shape to basically to the outer shape of the (wall of the) plug connector and it thus not limited to a circular form.

When the shielding element is provided on the plug connector and the plug connector with the shielding element thereon is inserted into the casing sleeve, the one or more tabs are bend inwards by the casing sleeve and are pressing outwards when the plug connector is provided inside the casing sleeve, while this allows for a defined force and therefore for a defined connection between the shielding element and the casing sleeve, regardless of the positional accuracy of the placement of the plug connector in the direction of the insertion of the plug connector into the casing sleeve.

Furthermore, when the shielding element abuts the wall of the plug connector, it is prevented from a lateral displacement, such avoiding the risk of the insertion of the plug connector into the casing sleeve being blocked by a moved shielding element. Due to the oblique arrangement of the one of more tabs, the force of the casing sleeve exerted thereon is directed mostly inwards, such that it less likely that the shielding element will be moved in direction of the insertion, even if no particular means for locking the shielding element in place are provided in addition.

In an advantageous embodiment, shielding element further comprises one or more contacting elements arranged to extend inside the plug connector for electrical connection.

Such contacting element may be provided for electrically connecting the shielding element with a ground potential of the plug connector, e.g., by providing a conductive connection to a circuit board or pin of the plug connector. This contacting element is preferably soldered to the pin or circuit board upon assembly of the plug connector.

Alternatively or in addition, such contacting element(s) may be provided for electrically connecting the shielding element with a shielding cross (or the like) inside the plug connector.

In another advantageous embodiment, the shielding element further comprises one or more fixing elements arranged to extend into respective recesses in the wall of the plug connector for fixing the shielding element on the plug connector.

The fixing element or elements are preferably spring-loaded and engage into corresponding bays or openings of the plug connector (more specifically of the wall of the plug connector), thereby preventing a movement of the shielding element along the wall of the plug connector, at least in one direction.

In yet another advantageous embodiment, the shielding element further comprises one or more engagement elements formed to engage with respective projections of the wall of the plug connector.

The engagement element or elements are preferably combined with the above mentioned fixing element, so that an abutment of the engagement element(s) with the corresponding projection(s) of the wall of the plug connector restricts a movement of the shielding element along the wall in one direction, while an opposite movement is prevented once the one or more fixing elements engage with their counterparts.

Furthermore, the arrangement and/or shape of the engagement element(s) allow for preventing a misaligned placement of the shielding element on the plug connector. In a case where the shape of the wall, due to its symmetry, allows more than placement of the shielding element thereon, the engagement element(s) may prevent that the shielding element is provided in not the correct placement.

In another advantageous embodiment, the shielding element further comprises locking elements arranged for a positive fit with each other, so that the shielding element encloses the wall of the plug connector.

In particular in a case where the ribbon shaped shielding element is formed, for example, by bending, by way of the locking elements with positive fit an easy and reliable closing of the shielding element around the wall of the plug connector may be achieved.

In another advantageous embodiment, the shielding element is formed by stamping and bending.

While other ways of producing the shielding element are also contemplated, the process of stamping and bending is advantageous in allowing an effective way for achieving the characteristics desired for the shielding element.

The shielding element may advantageously be combined with the plug connector, thus providing a system including a plug connector according to embodiments of the invention and a shielding element according to embodiments of the invention, wherein the shielding element extends around a wall of the plug body.

In an advantageous embodiment of such system at least one of the contacting elements of the shielding element is in electrical contact with a ground potential of the contact element of the plug connector, wherein a shielding cross is inserted in the plug body, and wherein the plug body includes one or more through holes through which respective contacting elements of the shielding element and/or projections of the shielding cross extend so that the shielding cross and the shielding element are in conductive connection.

BRIEF DESCRIPTION OF THE SEVERAL VIEWS OF THE DRAWINGS

The invention shall now be described in greater detail with reference to the Figures and to preferred embodiments.

DETAILED DESCRIPTION

Figure 1:
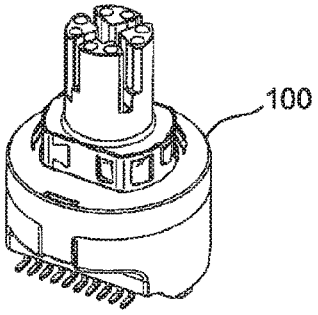
FIG. 1 shows a plug connector according to a first embodiment of the invention.

FIG. 1 shows a plug connector 100 according to a first embodiment of the invention. The details of the plug connector 100 can be seen in the exploded view of the plug connector 100 in FIG. 2.

The plug connector 100 has a plug base 110, a contact element 120, a plug body 130 and a cover 140, which are "stacked" on top of each other in that order.

The plug base 110 has a base body 114 which is provided with a plurality of terminal contacts 112 and base-side connection contacts 113. The base body 114 also has a transformer chamber 115, in which the transformer unit (not shown here) that connects the terminal contacts 112 under galvanic separation to the base-side connection contacts 113 is accommodated. The terminal contacts 112 are approximately L-shaped. In the view shown in FIG. 2, the short legs are oriented parallel to each other in a plane at the bottom end of the plug base 110, the long legs of the terminal contacts 112 extending through the base body 114 of the plug base 110 (in the upward direction in the view shown in FIG. 2), where they project-like the base-side connection contacts 113 as well-from the base body 114. Further details of the plug base 110 shall be described further below with reference to FIGS. 8 to 12.

The contact element 120 has a substrate 124 which is provided with inner through holes 121 and first and second outer through holes 122, 123. The positioning of the first and second outer through holes 122, 123 corresponds to the positions of the terminal contacts 112 and the base-side connection contacts 113 (see also FIG. 8 or FIG. 10) of the plug base 110. In particular, the first outer through holes 122 are arranged on long sides of a rectangle in such a way that they can receive the terminal contacts 112, the second outer through holes 123 being arranged on short sides of the rectangle in such a way that they can receive the base-side connection contacts 113. However, different arrangements of the outer through holes 122, 123 are also possible. The positions of the inner through holes 121 correspond to the positions of plug contacts 131 of the plug body 130 (see below). The second outer through holes 123 are connected by conductive strips (see FIG. 14) to the inner through holes 121, according to the assignment of base-side connection contacts 113 and plug contacts 131.

Depending on the desired function of the plug connector 100, it is also possible for individual first outer through holes 122 to be connected (directly) to one or more inner through holes 121, so that direct contact is established between one or more terminal contacts 112 and one or more plug contacts 131 (or some other element of the plug body 130).

The plug body 130 comprises a plug base body 134 having a plurality of contact chambers 135 and a plurality of plug contacts 131. In what is basically a known manner, the plug contacts 131 each have a first portion located in a respective contact chamber 135, and a further portion which extends out of the plug base body 134 (namely downwards in the view shown in FIG. 2). Apart from its modification to match with the contact element 120, the plug body 130 is otherwise substantially identical to known plug bodies and similar elements in known plug connectors.

The plug connector 100 is provided with a shielding element 300 partially enclosing the plug body 130, wherein the shielding element 300 is discussed and explained in further detail below, in particular referring to FIGS. 15 to 17.

The plug connector 100 is assembled in such a way that the plug contacts 131 of the plug body 130 (or more precisely the respective further portions of the plug contacts 131 that extend outside the plug base body 134) are guided through the inner through holes 121 of contact element 120 and are fixed and electrically contacted there using a technique for soldering in, e.g., by means of the so-called "paste-in-hole" technique. The resultant combination of the contact element 120 and the plug body 130 is then brought together with the plug base 110 in such a way that the base-side connection contacts 113 and the adjacent portions of terminal contacts 112 extend through the second and first outer through holes 123, 122 of contact element 120, where they are likewise fixed and electrically contacted using said technique for soldering in. The cover 140 is then slid over and snap-locked onto the base body 114 of the plug base 110. When the plug body 130 and the contact element 120 are brought together, the side of the contact element 120 that is on the other side from plug body 130 is accessible, so said technique for soldering in can be used for electrical contacting and also for establishing a mechanical connection. When the provided combination of the plug body 130 and the contact element 120 is put onto the plug base 110, the plug base 110 blocks the previously free access to the side of contact element 120 that is on the other side from the plug body 130 and thus to the inner through holes 121. However, the outer through holes 122, 123 are in an area of contact element 120 that is not covered by the plug body 130 when attached, so access is provided here for the corresponding technique for soldering in.

Figure 3:
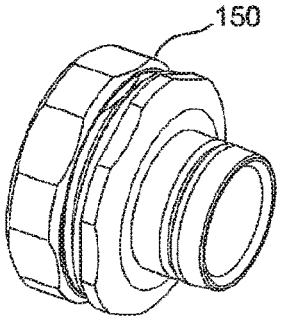
FIG. 3 shows a first variant of a casing sleeve for the plug connector in FIG. 1.
Figure 4:
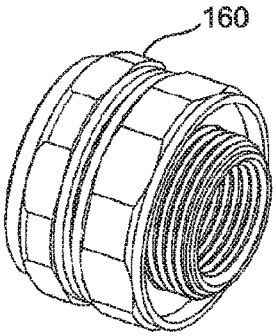
FIG. 4 shows a second variant of a casing sleeve for the plug connector in FIG. 1.
Figure 5:
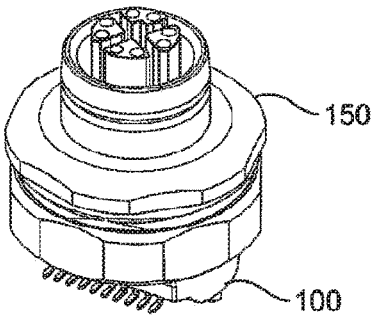
FIG. 5 shows the plug connector in FIG. 1 with a casing sleeve from FIG. 3 attached thereto.

FIGS. 3 and FIG. 4 show a first and a second variant of a casing sleeve for the plug connector 100 in FIG. 1, whereas FIG. 5 shows the plug connector 100 from FIG. 1 with a casing sleeve 150 from FIG. 3 attached thereto. The casing sleeve 150 from FIG. 3 is used for a front mounting on a housing, whereas the casing sleeve 160 from FIG. 4 is used for a rear mounting.

Figure 6:
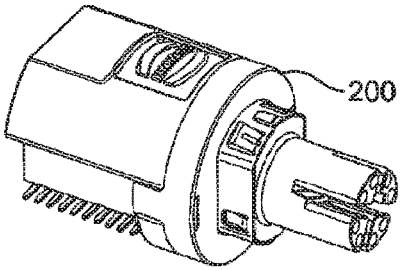
FIG. 6 shows a plug connector according to a second embodiment of the invention.
Figure 7:
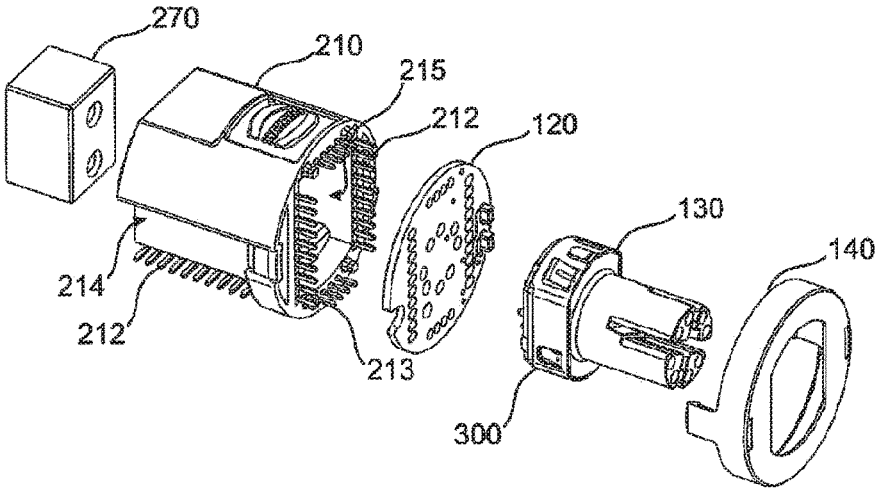
FIG. 7 shows an exploded view of the plug connector in FIG. 6.

FIG. 6 shows a plug connector 200 according to a second embodiment of the invention. The details of the plug connector 200 can be seen in the exploded view of the plug connector 200 in FIG. 7. The plug connector 200, similar to the one shown in FIGS. 1 and 2, has a plug base 210, a contact element 120, a plug body 130 and a cover 140, which again are "stacked" on top of each other in that order. The contact element 120, the plug body 130 and the cover 140 are identical here to the elements of the plug connector 100 in FIG. 2, so a repetition of the above description can be dispensed with.

The plug base 210 has a base body 214 which is provided with a plurality of terminal contacts 212 and base-side connection contacts 213. The base body 214 also has a transformer chamber 215, in which the transformer unit (not shown here) is accommodated, the transformer unit connecting the terminal contacts 212 under galvanic separation to the base-side connection contacts 213. The terminal contacts 212 are so designed that respective portions which are provided for contacting a printed circuit board or similar on which plug connector 200 is to be mounted are arranged adjacent to each other in a plane (horizontal, in the perspective view shown in FIG. 7). The terminal contacts 212 also extend through the base member 214 and then project-in common with the base-side connection contacts 213—out of the base member 214 (to the right in the perspective view shown in FIG. 7). The plug base 210 differs from the plug base 110 in FIG. 2 in that a 90° angle is provided here between a plane defined by the short legs ("feet") of the terminal contacts 212 and the plane of the base-side connection contacts 113 (i.e., the plane of contact element 120). For stabilization, the angled plug connector 200 also includes a counterweight 270, allowing for an automated assembly on the circuit board, e.g., by way of the so-called "pick & place" technique. The plug connector 200 is assembled in a way corresponding to that discussed above with reference to the plug connector 100 in FIG. 2.

The plug connector 200 is, similar to the plug connector 100 discussed above, provided with a shielding element 300 partially enclosing the plug body 130, wherein the shielding element 300 is discussed and explained in further detail below, in particular referring to FIGS. 15 to 17.

Figure 2:
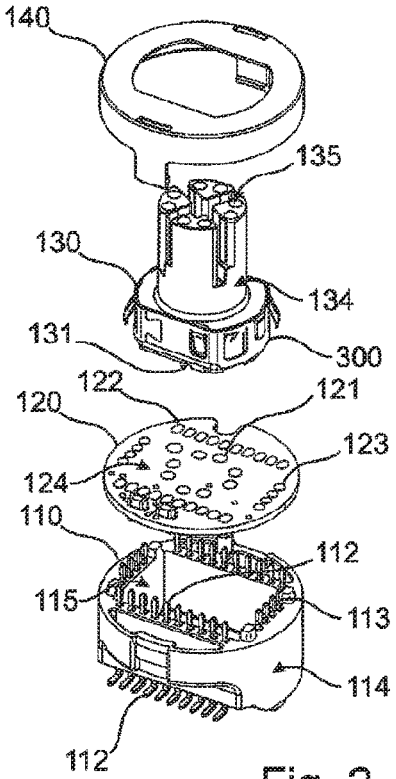
FIG. 2 shows an exploded view of the plug connector in FIG. 1.
Figure 8:
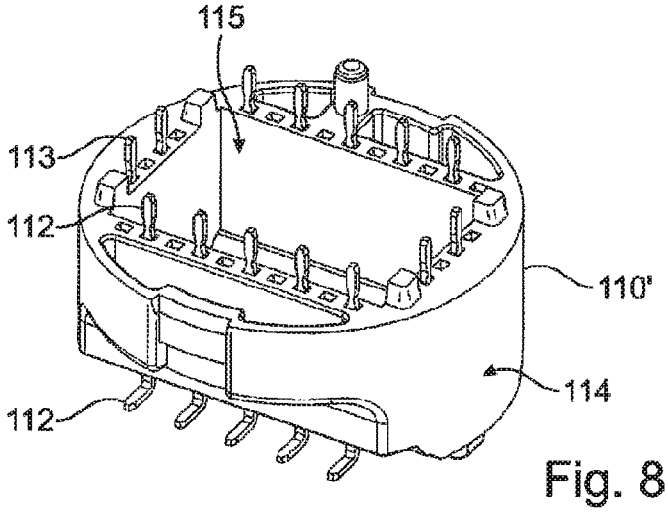
FIG. 8 shows a modified variant of a plug base of the plug connector in FIGS. 1 and 2.
Figure 9:
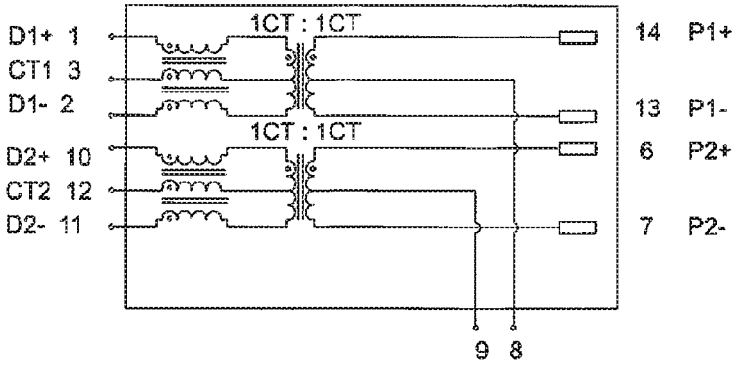
FIG. 9 shows a circuit diagram for the transformer unit of the plug base in FIG. 8.

FIG. 8 shows a plug base 110' as a modification of the plug base 110 of plug connector 100 from FIGS. 1 and 2, with FIG. 9 showing a circuit diagram for the transformer unit of plug base 110' in FIG. 8. In contrast to the view shown in FIG. 2, for example (see also FIG. 10), the plug base 110' has a smaller number of terminal contacts 112 and base-side connection contacts 113 (e.g., for 10/100 Megabit transmission rather than 1/10 Gigabit transmission, as in the case of FIG. 2 or FIG. 10), although the base body 114 of the plug base 110' is identical to the base body 114 of the plug base 110 (see FIG. 2 and FIG. 10) and for that reason is also marked with the same reference sign. The transformer unit (not shown in FIG. 8) is accommodated inside the base body 114 (or more precisely in the transformer chamber 115) and connected to the terminal contacts 112 and the base-side connection contacts 113 in accordance with the circuit diagram shown in FIG. 9. As already explained in the foregoing, the L-shaped connection contacts 112 each extend through the base body 114, such that short legs (with which the plug connector 100 as a whole is connected to a printed circuit board or the like) are present in the lower region and freely projecting pin portions of the long legs are present in the upper region (in the view shown in FIG. 8). As shown in FIG. 9, the terminal contacts 112 (pins 1-3, 11-12) are each connected to transformers of the transformer unit (indicated here as the primary side), the secondary side of the transformer unit being connected to base-side connection contacts 113 (pins 6, 7, 13, 14). Further, the secondary side center taps for "Power-over-Ethernet" transmission (PoE) are electrically connected to further terminal contact 112 (pins 8, 9), which may be wired, depending on the application, for providing power, i.e., as "Power Source Equipment" (PSE), or for receiving power, i.e., as "Powered Device" (PD). These terminal contacts 112 (pins 8, 9) are connected via a low pass filter, provided for transmission of the PoE supply voltage, mounted on the contact element 120, via suitable components (capacitors, Ohmic resistances) and conductive strips of the contact element 120 to a further terminal contact 112 (pin 5), particularly including a so-called "Bob-Smith termination", while this terminal contact 112 (pin 5) is in turn provided, upon mounting the plug connector 100 to a circuit board, for example, for being connected to ground potential of the circuit board. Thus, in this example, just one terminal contact (pin 4) remains unassigned.

Thus, all primary side contacts of the transformers and their secondary side so-called PoE contacts may be connected via the terminal contacts 112 in electrically conductive manner with connections of the circuit board, on which the plug connector 100 is mounted, and are thus available to the circuitry design of the circuit board. The production of the plug base 110' includes introducing the transformer unit into the transformer chamber 115 of the base body 114 with wiring in such a way that the primary side and the secondary side of the transformer are connected in the desired manner to the terminal contacts 112 and the base-side connection contacts 113, respectively.

Figure 10:
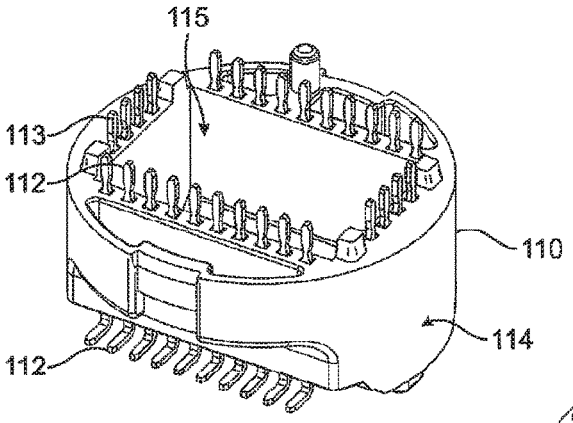
FIG. 10 shows the plug base of the plug connector in FIGS. 1 and 2.
Figure 11:
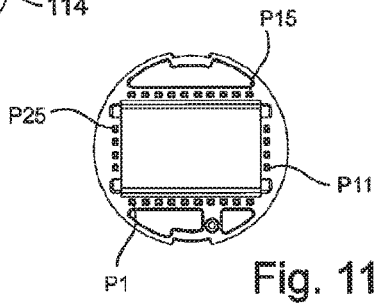
FIG. 11 shows a plan view onto the plug base from FIG. 10, illustrating the pin assignment.
Figure 12:
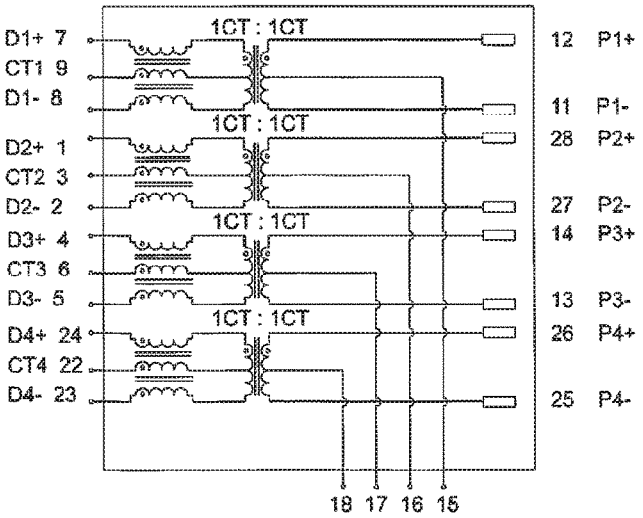
FIG. 12 shows a circuit diagram for the transformer unit of the plug base from FIG. 10, FIG. 13 show a view of the plug body of the plug connector of FIG. 2.

FIG. 10 shows plug base 110 of the plug connector from FIGS. 1 and 2, with FIG. 11 showing a plan view onto plug base 110 from FIG. 10 in order to illustrate the pin assignment, and FIG. 12 showing a circuit diagrams for the transformer unit of the plug base from FIG. 10.

As already discussed above, plug base 110 includes a base member 114 provided with terminal contacts 112 and base-side connection contacts 113, between which an electrical connection as shown in FIG. 12 is provided. An example of the pin assignment of pins 1 to 28 (numbered counterclockwise, as indicated in FIG. 11) is shown in FIG. 12. Four of the terminal contacts 112 (pins 15, 16, 17, 18) carry, corresponding to the embodiment discussed above, due to connection to the respective center taps, the associated PoE supply voltage. These four terminal contacts (pins 15, 16, 17, 18) are, again corresponding to the embodiment discussed above, for extraction of the PoE supply voltage connected via said low pass filer, in particular in "Bob-Smith termination", via suitable components and conductive strips of the contact element 120 to a further terminal contact 112 (pin 10), while this further terminal contact 112 (pin 10) is provided for being connected to ground potential of the respective circuit board (here, pins 19, 20 and 21 are unassigned). Apart from the number of terminal contacts 112, the observations made above with reference to FIGS. 8 and 9 apply analogously for FIGS. 10 to 12.

Figure 13:
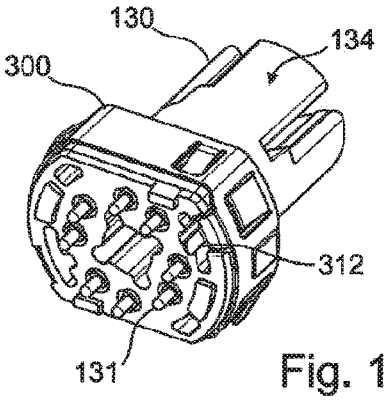

FIG. 13 shows a view of the plug body 130 of the plug connector 100 shown in FIG. 2. In the illustration shown in FIG. 13, giving a view of the plug body from below in the depiction of FIG. 2, the plug contacts 131 of the plug body 130 are better to be seen, projecting from the plug base body 134 in the direction of the contact element 120 (see FIG. 2). Furthermore, also the shielding element 300 partially enclosing the plug body is shown, wherein, similar to the plug contacts 131 of the plug body, a circuit board contacting element 312 projects from the shielding element 300 in the direction of the contact element 120 (see FIG. 2).

Figure 14:
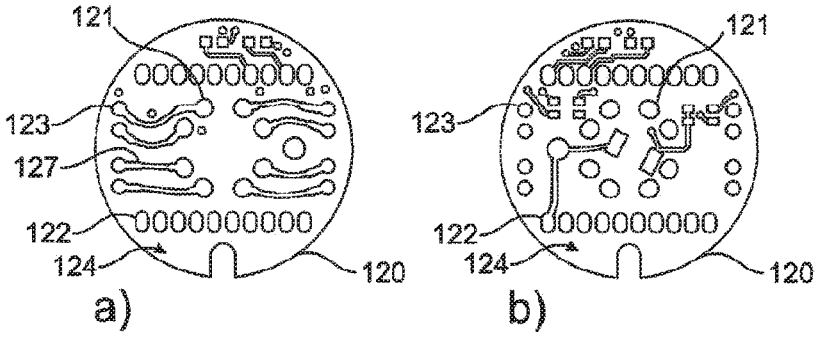
FIG. 14 shows views of a contact element with conductive strips.

FIG. 14 *a*) and FIG. 14 *b*) show views of an upper side and a lower side of a contact element 120 in accordance to an embodiment of the invention. The contact element 120 comprises, as mentioned above, a substrate 124 with inner through holes 121 and first and second outer through holes 122, 123. The inner through holes 121 are connected by conductive strips 127 with the second outer through holes 123, respectively. The substrate 124 (or the contact element 120) has further conductive strips and spaces for additional components, which are not further discussed here.

Figure 15:
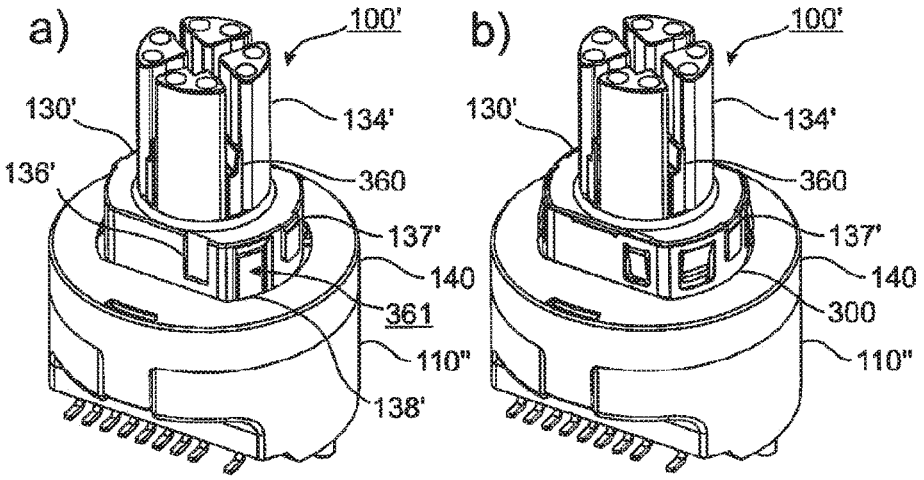
FIG. 15 shows views of a plug connector according to a further embodiment with and without a shielding element according to an embodiment.

FIG. 15 shows views of a plug connector 100' according to a further embodiment with (FIG. 15 *b*)) and without (FIG. 15 *a*)) a shielding element 300 according to an embodiment.

Similar to the plug connector 100 discussed above and illustrated, for example, in FIG. 2, the plug connector 100' includes a plug base 110", a contact element (not shown), a plug body 130' and a cover 140.

As the structure and function of these elements is very similar or even identical to the corresponding elements discussed with respect to the plug connector 100, here focus is given to the differences.

The plug body 130' is provided with a shielding cross 360 (see FIG. 18), which extends between the pairs of conductors/contact chambers provided within the plug base body 134'.

The plug body 130' includes two through holes 138' (one shown only), through which a projection of the shielding cross 360 at least partially extends, providing a contact area 361 close to or flush with the outer surface (or wall) of the plug body 130'.

The plug body 130' further comprises two recesses 136' (one shown only), each for engagement with or receiving of a respective fixing element (304, see FIG. 16) of the shielding element 300. In addition, the plug body 130' includes two projections 137' (one shown only), which cooperate with cut-outs or engagement elements (306, 306', see FIG. 16) of the shielding element 300.

In a case where the shielding element 300 is provided on the plug body 130' of the plug connector 100', the projections 137' are received in the engagement elements of the shielding element 300 and the fixing elements of the shielding element 300 are received in the recesses 136', so to lock the shielding element 300 on the plug body 130' against further movement along the plug-in direction of the plug connector 100'.

Provided that the contact area 361 of the shielding cross 360 would be substantially flush with the outer surface of the plug body 130', the outer geometry of the plug body 130 shown in FIG. 2, for example, may preferably correspond to that of the plug body 130' discussed here, wherein the through-hole 138 is not provided therein, so that the same shielding element 300 may be used for both embodiments of the plug connector 100, 100'. If the contact area 361 is typically not flush, a corresponding recess at the appropriate location could be provided in the case of the embodiment illustrated in FIG. 2.

The provision of the shielding cross 360 in connection with the shielding element 300 allows, in comparison to the embodiment shown in FIG. 2, for example, for a high frequency in the signals passing through the plug connector, as the shielding between the conductor pairs is increased.

With higher frequencies, it is of advantage to have connections between the shielding cross and the shielding element which are not too much spaced apart.

Thus, differing from the embodiment shown, three or all four legs of the shielding cross may be provided with contact areas for contacting with the shielding element. Other arrangements are also contemplated.

Figure 16:
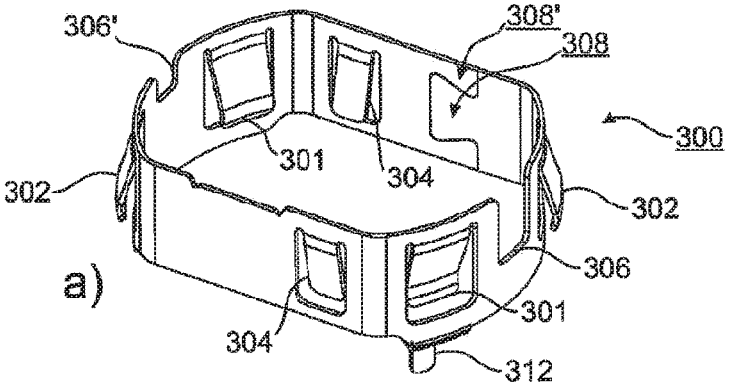
FIG. 16 shows views of the shielding element according to the embodiment of FIG. 15.
Figure 16:
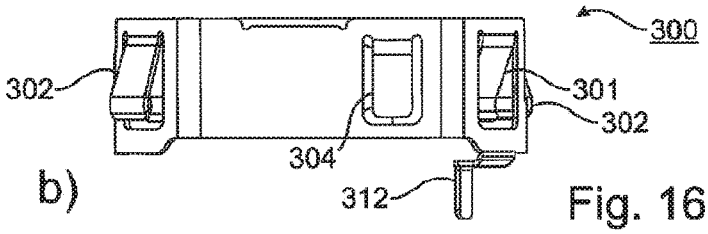

FIG. 16 shows views of the shielding element 300 according to the embodiment of FIG. 15. The shielding element 300 is shaped like a closed ribbon and encloses and abuts the outer surface or wall of the plug body of a plug connector as illustrated in, for example, FIG. 15 *b*).

The shielding element 300 includes two contacting elements 301 for contacting the contact area 361 of a shield cross as shown in FIG. 15 *a*). These shield cross contacting elements 301 extend from an upper portion (in the illustration) of the shield element 300 is an oblique way, i.e., tilted inwards, so that there is an elastic force pressing the shield cross contact elements 301 on the contact areas of the shield cross when the shielding element 300 is provided on the plug body.

The shielding element 300 further includes two tabs 302, each extending outwards in a way corresponding to the inwards extension of the shielding cross contacting elements 301. The tabs 302 are provided for contacting the casing sleeve 150 (see FIG. 17).

The shielding element 300 furthermore includes two fixing elements 304, wherein the fixing elements 304 also extend inwards and are provided such that they engage with corresponding recesses of the plug body (see FIG. 15).

The shielding element 300 is, in its cross section, basically symmetric, while the shielding element 300 includes two engagement elements 306, 306' in the form of cut-out of different size. In cooperation with corresponding projections of the plug body (see FIG. 15), this arrangement prevents an incorrect placement (i.e., turned by 180° or upside-down) of the shielding element 300 on the plug body.

The ribbon shape of the shielding element 300 is closed by way of a dovetail-connection between corresponding locking elements 308, 308'.

The shielding element 300 furthermore includes a circuit board contacting element 312 extending downwards (in the illustration), allowing for a connection between the shielding element 300 and a circuit board of the plug connector as shown in FIG. 2, for example.

Figure 17:
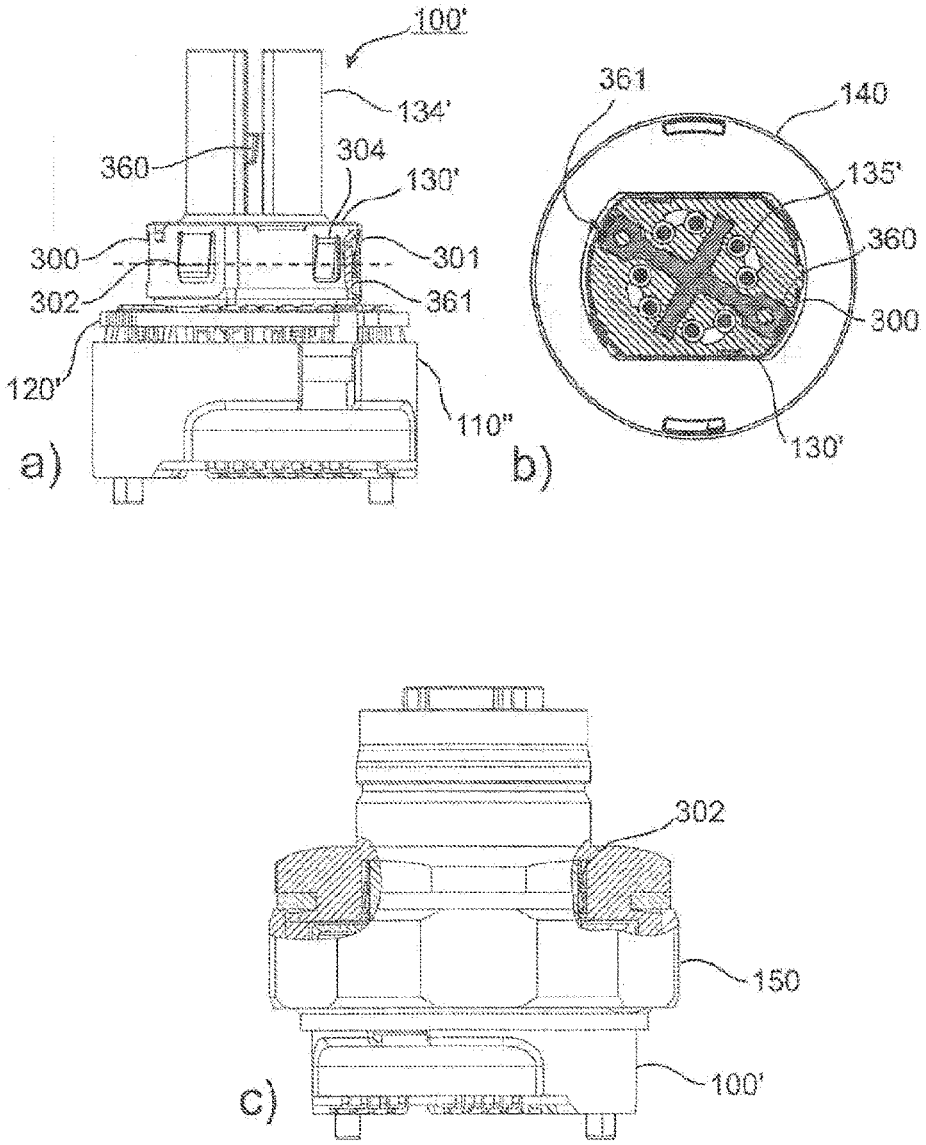
FIG. 17 shows views of the plug connector illustrated in FIG. 15.

FIG. 17 shows views of the plug connector 100' illustrated in FIG. 15.

As the cover 140 shown in FIG. 15 attached to the plug connector 100' is not provided in the illustration of FIG. 17 *a*), it can be seen that the plug connector 100' includes the plug base 110", a contact element 120', the plug body 130', stacked in this order. The plug connector 100' is also provided with the shielding element 300 as shown, for example, in FIG. 16, which includes tabs 302 (one of which is shown in FIG. 17 *a*)), shield cross contacting elements 301 (one of which is shown in the partial cross sectional view of FIG. 17 *a*)) and fixing elements (one of which is shown in FIG. 17 *a*)). Furthermore, the plug connector 100' includes a shielding cross 360, which is provided in the plug body 130' and extends partially in the plug base body 134'. The shielding cross 360 is provided with contact areas 361, which are in conductive contact with the shielding cross contacting elements 301 of the shielding element 300.

FIG. 17 *b*) shows a cross sectional view of the plug connector 100' of FIG. 15 along the slashed line shown in FIG. 17 *a*)). The plane of projection of FIG. 17 *a*) extends along the arms of the shielding cross 360 and does therefore not correspond to the rotational arrangement of FIG. 17 *b*) (tilted clockwise by approximately 28.5°). For reference, the cover 140 is also shown in FIG. 17 *b*). The shielding element 300 encloses the plug body 130', in which the shielding cross 360 is provided. Two arms of the shielding cross 360 extend with their contact areas 361 to the shielding cross contacting elements 301 of the shielding element. The shielding cross 360 is provided between the contact chamber 135' of the plug body 130'.

FIG. 17 *c*) shows an illustration of the plug connector 100' with the casing sleeve 150 shown in FIG. 3 attached thereto. As shown by the partial cross sectional views of the illustrations of FIG. 17 *c*), the tabs 302 of the shielding element 300 are in contact with the inner surface of the casing sleeve 150, thus providing a conductive connection between the casing sleeve 150 and the shielding cross 360.

The plane of projection of FIG. 17 *c*) is rotated around the vertical axis of the plug connector 100' by approximately 28.5° counterclockwise in comparison to that of FIG. 17 *a*).

Figure 18:
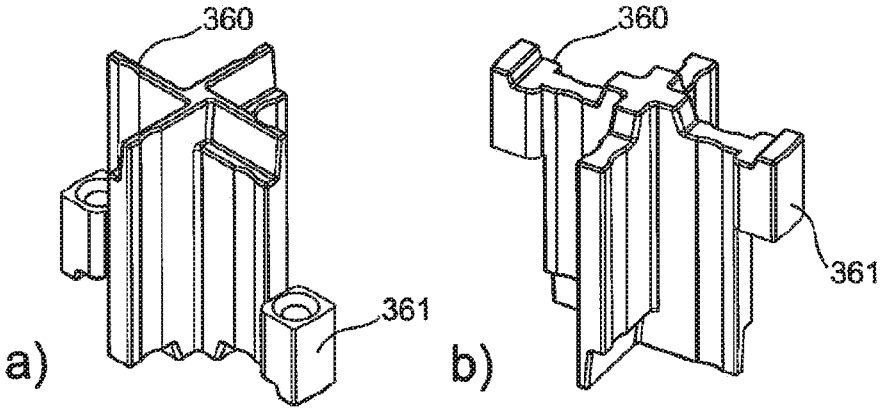
FIG. 18 shows a shielding cross of the plug connector illustrated in FIG. 15.

FIG. 18 shows two views of a shielding cross 360 of the plug connector illustrated in FIG. 15. As discussed above, two of the arms of the shielding cross 360 are provided with contact areas 361 at their respective ends. As the skilled person is familiar with the basic structure and function of a shielding cross, no further explanation is needed here.

In the discussion above, aspects of the invention were described with reference to embodiments in which the plug connector is a socket plug connector, i.e., the female version of a male-female pair. However, the invention not limited to this variant and can also be realized with a male version (e.g., with projecting pin contacts instead of individual contact chambers), or also with a neutral or hybrid version.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plug connector, comprising:

a plug base with terminal contacts for external contacting of the plug connector, base-side connection contacts, and a transformer unit for galvanic separation in at least a conductive path between the terminal contacts and the base-side connecting contacts; and a plug body with plug contacts, wherein the plug base and the plug body enclose a contact element for connecting the base-side connecting contacts to the plug contacts, and wherein the contact element is planar in a plane perpendicular to a plug-in direction of the plug body.

2. The plug connector according to claim 1, wherein the contact element is embodied as a printed circuit board.

3. The plug connector according to claim 1, wherein the contact element has outer through holes and inner through holes through which the base-side connecting contacts on the base side and the plug contacts on the plug body respectively extend, in which the base-side connecting contacts and the plug contacts are fixed, and with which the base-side connecting contacts and the plug contacts are electrically connected, and which are connected to each other by conductors.

4. The plug connector according to claim 1, wherein the contact element is adapted for a one-to-one arrangement of the contact element in relation to the base-side connecting contacts and/or the plug contacts.

5. The plug connector according to claim 1, wherein ends of the terminal contacts of the plug base are arranged in a plane which is parallel to the plane of the contact element, or perpendicular thereto.

6. The plug connector according to claim 1, wherein the plug connector is a round plug connector.

7. The plug connector according to claim 6, wherein the round plug connector is an M12, M8 or M6 plug connector.

8. A shielding element for a plug connector and conductively contacting a casing sleeve of the plug connector, the shielding element being ribbon shaped and arranged for extending at least partially around a wall of the plug connector which extends in a connection direction of the plug connector and the casing sleeve, wherein the shielding element includes one or more tabs extending obliquely, so to form an acute angle which faces away from the casing sleeve upon connection of the plug connector and the casing sleeve.

9. The shielding element according to claim 8, further comprising one or more contacting elements arranged to extend inside the plug connector for electrical connection.

10. The shielding element according to claim 8, further comprising one or more fixing elements arranged to extend into respective recesses in the wall of the plug connector for fixing the shielding element on the plug connector.

11. The shielding element according to claim 8, further comprising one or more engagement elements formed to engage with respective projections of the wall of the plug connector.

12. The shielding element according to claim 8, further comprising locking elements arranged for a positive fit with each other, so that the shielding element encloses the wall of the plug connector.

13. The shielding element according to claim 8, wherein the shielding element is formed by stamping and bending.

14. A system including a plug connector and a shielding element, the plug connector comprising:

a plug base with terminal contacts for external contacting of the plug connector, base-side connection contacts, and a transformer unit for galvanic separation in at least a conductive path between the terminal contacts and the base-side connecting contacts; and a plug body with plug contacts, wherein the plug base and the plug body enclose a contact element for connecting the base-side connecting contacts to the plug contacts, and wherein the contact element is planar in a plane perpendicular to a plug-in direction of the plug body, and the shielding element being ribbon shaped and including one or more tabs extending obliquely, so to form an acute angle which faces away from the casing sleeve upon connection of the plug connector and the casing sleeve, and wherein the shielding element extends around a wall of the plug body of the plug connector.

15. The system according to claim 14, wherein the shielding element includes contacting elements and at least one of the contacting elements of the shielding element is in electrical contact with a ground potential of the contact element of the plug connector, wherein a shielding cross is inserted in the plug body of the plug connector, and wherein the plug body includes one or more through holes through which respective contacting elements of the shielding element and/or projections of the shielding cross extend so that the shielding cross and the shielding element are in conductive connection.

* * * * *